US010276328B1

(12) United States Patent
Cheng et al.

(10) Patent No.: US 10,276,328 B1
(45) Date of Patent: Apr. 30, 2019

(54) KEYBOARD STRUCTURE

(71) Applicant: Primax Electronics Ltd., Taipei (TW)

(72) Inventors: Hsiang-Wen Cheng, Taipei (TW); Sheng-An Tsai, Taipei (TW); Li-Jen Chien, Taipei (TW)

(73) Assignee: PRIMAX ELECTRONICS LTD, Taipei (TW)

( * ) Notice: Subject to any disclaimer, the term of this patent is extended or adjusted under 35 U.S.C. 154(b) by 0 days.

(21) Appl. No.: 15/990,384

(22) Filed: May 25, 2018

(30) Foreign Application Priority Data

Jan. 26, 2018 (TW) ..... 107102962 A

(51) Int. Cl.
*H01H 13/14* (2006.01)
*H01H 13/84* (2006.01)
*H01H 13/7065* (2006.01)
*H01H 13/52* (2006.01)

(52) U.S. Cl.
CPC ..... *H01H 13/84* (2013.01); *H01H 13/52* (2013.01); *H01H 13/7065* (2013.01); *H01H 2215/03* (2013.01)

(58) Field of Classification Search
CPC ..... H01H 13/14; H01H 13/83; H01H 3/125; H01H 13/04; H01H 13/7065; H01H 13/704; H01H 13/86; H01H 13/70; H01H 13/50; H01H 2215/004; H01H 13/20; H01H 3/12; H01H 13/22; H01H 2003/008; H01H 13/84; H01H 13/52; H01H 2215/03
USPC ..... 200/5 A, 341, 517, 512, 521, 345, 314, 200/343, 4, 513, 520, 408
See application file for complete search history.

(56) References Cited

U.S. PATENT DOCUMENTS

| | | | | |
|---|---|---|---|---|
| 4,642,433 | A * | 2/1987 | Murata | H01H 13/50 200/308 |
| 5,488,210 | A * | 1/1996 | Shigetaka | H01H 3/125 200/344 |
| 7,906,739 | B2 * | 3/2011 | Villain | H05K 3/303 200/292 |
| 9,543,090 | B2 * | 1/2017 | Krumpelman | H01H 13/14 |
| 2011/0031099 | A1 * | 2/2011 | Inamoto | H01H 13/85 200/513 |
| 2015/0279591 | A1 * | 10/2015 | Pan | H01H 13/85 200/5 A |
| 2015/0348726 | A1 * | 12/2015 | Hendren | H01H 13/85 200/513 |
| 2016/0172129 | A1 * | 6/2016 | Zercoe | H01H 13/023 200/5 A |

* cited by examiner

*Primary Examiner* — Ahmed M Saeed
(74) *Attorney, Agent, or Firm* — Kirton McConkie; Evan R. Witt

(57) ABSTRACT

A keyboard structure includes a keycap, a supporting plate, a connecting element and a clicking element. The keycap has a top surface and a bottom surface. The connecting element is connected with the keycap and the supporting plate. The clicking element is located under the keycap. While the keycap is descended, the clicking element is pressed by the push post and subjected to curvy deformation and then the clicking element is separated from the push post. When the clicking element is elastically restored to an original position to knock on the bottom surface of the keycap, a click sound is generated.

14 Claims, 5 Drawing Sheets

*FIG. 1*

KEYBOARD STRUCTURE

FIELD OF THE INVENTION

The present invention relates to the field of an input device, and more particularly to a keyboard structure.

BACKGROUND OF THE INVENTION

In modern societies, electronic products become indispensable parts in human lives. The electronic products are applied in many sectors, including food, clothing, housing, transportation, education and entertainment. For facilitating carrying and using electronic products, the trends of designing electronic products are toward light weightiness and slimness. Generally, the electronic product is equipped with a keyboard. In case that the keyboard device is a mechanical keyboard, the mechanical keyboard has various shafts. The shafts are classified according to their colors. For example, these colors include a blue color, a red color, a black color, a brown color and a green color. The shafts of the mechanical keyboard with different colors require different actuation forces and generate different click sounds. Consequently, the mechanical keyboard generates different clicking sensations. Moreover, because of the proper click sound and the proper actuation force, the suitable typing rhythm of the user can be maintained.

For allowing the electronic product to meet the requirements of light weightiness and slimness, it is necessary to simplify the arrangement of a support structure or an elastic structure of the keyboard structure or reduce the height of the supporting structure to reduce the overall volume of the keyboard structure. In other words, the structure of the slim keyboard is usually not equipped with the shafts of the mechanical keyboard. Under this circumstance, it is difficult for the slim keyboard to generate the proper click sound. However, since the user is unable to immediately realize whether the pressing action of the slim keyboard is completed or the uncomfortable tactile feel is generated, it is difficult to maintain the suitable typing rhythm of the user.

For solving the above drawbacks, it is necessary to simplify the keyboard structure while generating the proper click sound. For example, a keyboard structure is disclosed in U.S. Pat. No. 9,767,970. The keyboard structure comprises a keycap, a supporting plate and a scissors-type connecting element. A protrusion part is protruded from a bottom surface of the keycap. An elastic structure is disposed on the supporting plate and aligned with the protrusion part. While the keycap is moved downwardly, the protrusion part is moved toward the elastic structure. Since the elastic sheet is collided by the protrusion part, a click sound is generated. However, this keyboard structure still has some drawbacks. For example, since the protrusion part is protruded from the bottom surface of the keycap, the original coupling position between the keycap and the scissors-type connecting element is possibly changed. Moreover, the arrangement of the protrusion part increases the complexity of assembling the keyboard. Moreover, since the protrusion part is protruded from the bottom surface of the keycap, a material embrittlement problem occurs. If the keyboard structure is frequently pressed, the protrusion part is readily suffered from breakage or damage. Under this circumstance, the keyboard structure cannot generate the proper click sound.

For overcoming the above drawbacks, there is a need of providing a keyboard structure that has a simplified design and is easily assembled. When the keyboard structure is pressed, the proper click sound can be stably and continuously generated.

SUMMARY OF THE INVENTION

The present invention provides a keyboard structure that is simply assembled and is capable of stably and continuously generating a click sound.

In accordance with an aspect of the present invention, there is provided a keyboard structure. The keyboard structure includes a keycap, a supporting plate, a clicking element and a connecting element. The keycap has a top surface and a bottom surface. The clicking element is located under the keycap. The connecting element is connected with the keycap and the supporting plate. The connecting element includes a push post. The push post is contacted with the clicking element. While the keycap is descended, the clicking element is pressed by the push post and subjected to curvy deformation and then the clicking element is separated from the push post. When the clicking element is elastically restored to an original position to knock on the bottom surface of the keycap, a click sound is generated.

In an embodiment, the clicking element includes a clicking part and a fixing part.

In an embodiment, the push post has a slant surface, and the slant surface is contacted with the clicking part. While the keycap is descended, the clicking part is pressed by the slant surface of the push post and subjected to curvy deformation and then the clicking part is moved along the slant surface and separated from the push post. When the clicking part is elastically restored to an original position to knock on the bottom surface of the keycap, the click sound is generated.

In an embodiment, the clicking part comprises a clicking block. When the clicking block knocks on the bottom surface of the keycap, the click sound is generated.

In an embodiment, the supporting plate includes a positioning hole corresponding to the fixing part. The fixing part is accommodated within and positioned in the positioning hole, so that the clicking element is fixed in the supporting plate.

In an embodiment, the keyboard structure further includes a membrane layer. The membrane layer is located over the supporting plate, and the membrane layer includes a switch corresponding to the keycap.

In an embodiment, the keyboard structure further includes an elastic element. The elastic element is located over the switch. The elastic element provides an elastic restoring force to the keycap.

In an embodiment, while the keycap is descended, the elastic element is subjected to deformation and contacted with the switch, so that a keyboard signal is generated.

In an embodiment, the elastic element is made of rubber, silicone or metallic material.

In an embodiment, the connecting element includes a first frame and a second frame, and the push post is disposed on a lateral surface of the second frame.

In an embodiment, the keyboard structure further includes a printed circuit board. The printed circuit board is located under the supporting plate.

In an embodiment, the clicking element is made of a soft elastic material, a hard elastic material or a composite elastic material.

In an embodiment, the soft elastic material is silicone or PVC glue.

In an embodiment, the hard elastic material is ABS resin, polycarbonate, acrylic resin, stainless steel, galvanized steel, aluminum or copper.

In an embodiment, the composite elastic material is a composite material of the soft elastic material and the hard elastic material.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
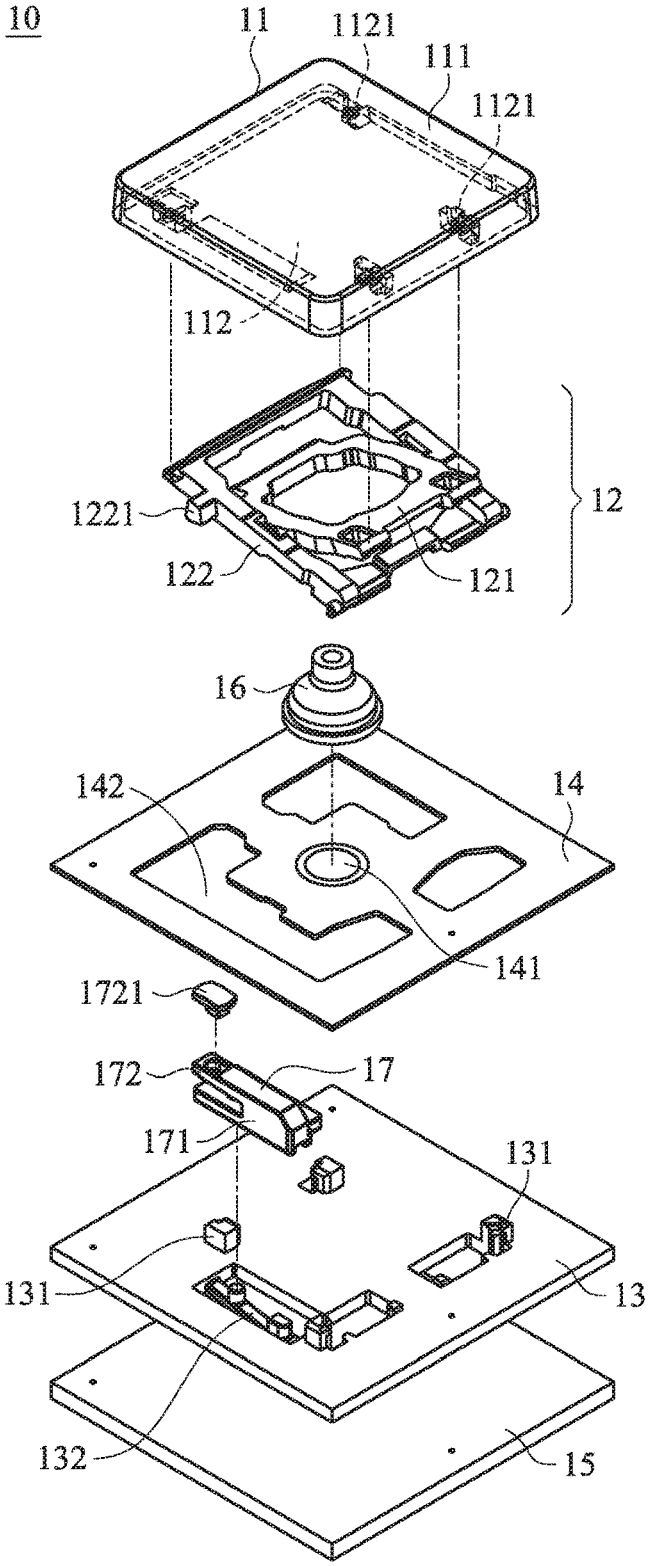
FIG. 1 is a schematic perspective view illustrating a keyboard structure according to an embodiment of the present invention.

Please refer to FIG. 1. FIG. 1 is a schematic perspective view illustrating a keyboard structure according to an embodiment of the present invention. As shown in FIG. 1, the keyboard structure 10 comprises a keycap 11, a connecting element 12, a supporting plate 13, a membrane layer 14, a printed circuit board (PCB) 15, an elastic element 16 and a clicking element 17.

Please refer to FIG. 1 again. The keycap 11 has a top surface 111 and a bottom surface 112. Moreover, plural first coupling parts 1121 are disposed on the bottom surface 112 of the keycap 11. The connecting element 12 comprises a first frame 121 and a second frame 122. The first frame 121 and the second frame 122 are pivotally to each other through a pivotal shaft. A push post 1221 is disposed on a lateral surface of the second frame 122. The supporting plate 13 comprises plural second coupling parts 131 and a positioning hole 132. The membrane layer 14 has the function of generating a keyboard signal. The membrane layer 14 is located over the supporting plate 13. The membrane layer 14 comprises a switch 141 and plural openings 142. The switch 141 is aligned with the keycap 11. The plural openings 142 are aligned with the second coupling parts 131 and the positioning hole 132. The elastic element 16 is located over the switch 141. The elastic element 16 is made of rubber, silicone or metallic material. The clicking element 17 comprises a fixing part 171 and an L-shaped clicking part 172, which are aligned with the positioning hole 132. A clicking bulge 172 is disposed on an end of the clicking part 172. The printed circuit board 15 is located under the supporting plate 13. The printed circuit board 15 provides electric power to a light-emitting element (not shown) of the keyboard structure 10.

Figure 2A:
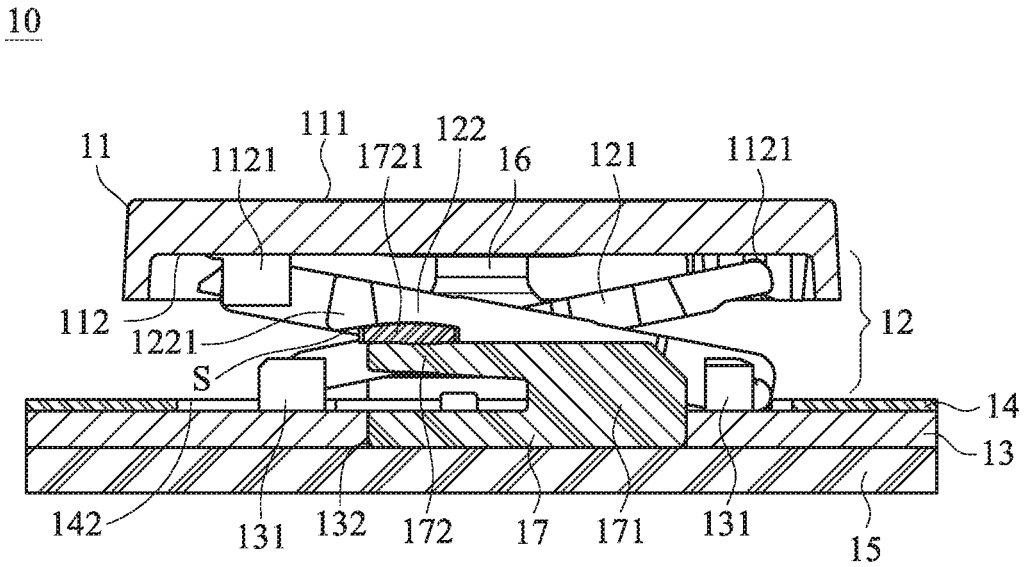
FIG. 2A is a schematic cross-sectional view of the keyboard structure according to the embodiment of the present invention.
Figure 2B:
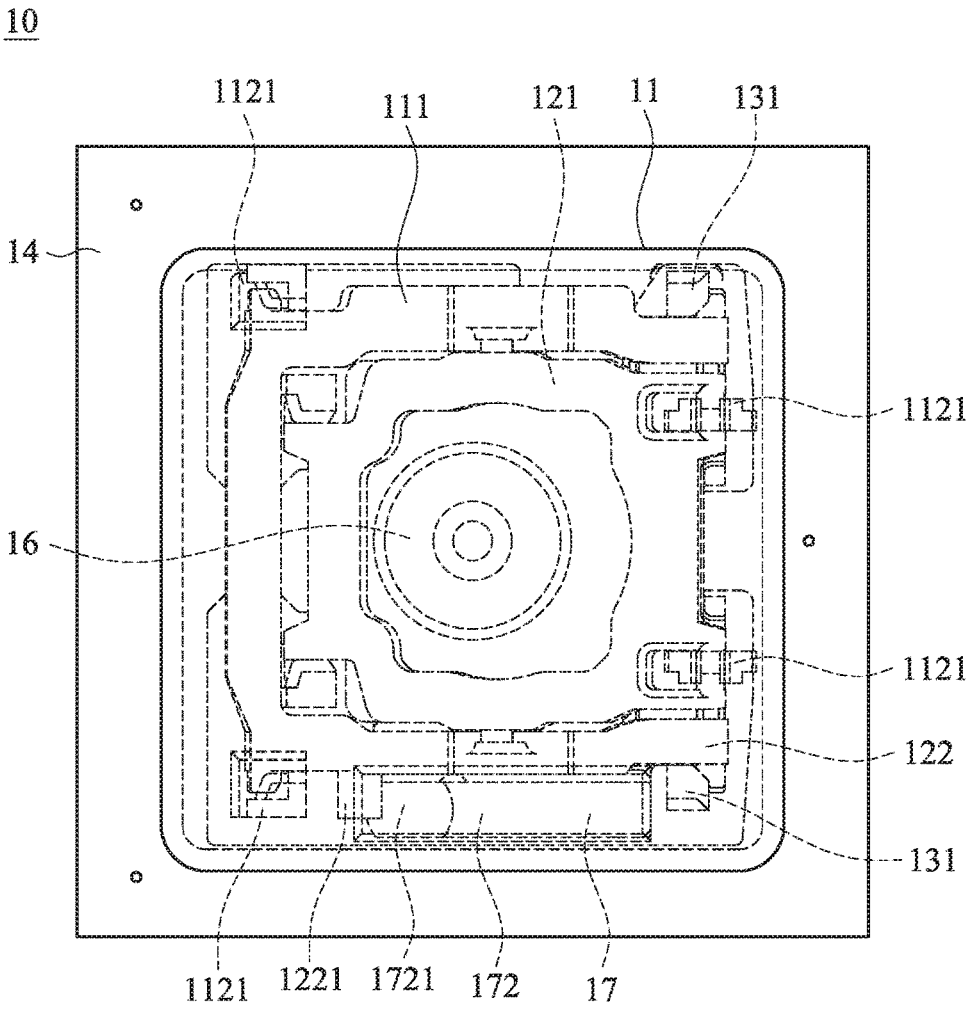
FIG. 2B is a schematic top view of the keyboard structure according to the embodiment of the present invention.

FIG. 2A is a schematic cross-sectional view of the keyboard structure according to the embodiment of the present invention. FIG. 2B is a schematic top view of the keyboard structure according to the embodiment of the present invention. After the keyboard structure is assembled, the resulting structure of the keyboard structure is shown in FIGS. 2A and 2B. The connecting element 12 is arranged around the elastic element 16. The first ends of the first frame 121 and the second frame 122 of the connecting element 12 are pivotally coupled to the first coupling parts 1121 of the keycap 11. The second coupling parts 131 of the supporting plate 13 are penetrated through the corresponding openings 142 of the membrane layer 14. Moreover, the second coupling parts 131 of the supporting plate 13 are pivotally coupled to the second ends of the first frame 121 and the second frame 122. Consequently, the first frame 121 and the second frame 122 are rotatably connected between the keycap 11 and the supporting plate 13, and the keycap 11 is driven and guided to be ascended or descended relative to the supporting plate 13. In an embodiment, the connecting element 12 is a scissors-type connecting element. It is noted that the example of the connecting element is not restricted. In another embodiment, the connecting element includes a V-shaped linkage, an A-shaped linkage or two parallel linkages.

The elastic element 16 over the switch 141 is contacted with the bottom surface 112 of the keycap 11. Moreover, the elastic element 16 provides an elastic restoring force to the keycap 11. When a pressing force is exerted on the top surface 111 of the keycap 11 and the keycap 11 is descended in response to the pressing force, the elastic element 16 is compressed and subjected to deformation. Consequently, the switch 141 (see FIG. 1) is triggered by the elastic element 16, and the keyboard signal is generated. When the top surface 111 is no longer pressed, the keycap 11 is ascended and returned to its original position in response to the upward elastic restoring force from the elastic element 16.

Please refer to FIGS. 2A and 2B again. The fixing part 171 of the clicking element 17 is accommodated within and positioned in the positioning hole 132 of the supporting plate 13. Especially, the clicking element 17 is penetrated through the corresponding opening 142 of the membrane layer 14 and fixed in the supporting plate 13. In the above embodiment, the clicking element 17 is fixed in the supporting plate 13. It is noted that numerous modifications and alterations may be made while retaining the teachings of the invention. For example, in another embodiment, the clicking element 17 is fixed on a surface of the membrane layer 14 or a surface of the printed circuit board 15 through an adhering means. Moreover, the push post 1221 on the lateral surface of the second frame 122 has a slant surface S. The slant surface S of the push post 1221 is contacted with an end of the L-shaped clicking part 172. Consequently, the push post 1221 and the clicking part 172 are interfered with each other. Moreover, the slant surface S of the push post 1221 is contacted with a clicking block 1721 at the end of the clicking part 172. In the above embodiment, the push post 1221 is contacted with the clicking block 1721. It is noted that numerous modifications and alterations may be made while retaining the teachings of the invention. For example, in another embodiment, the clicking block 1721 is arranged near the end of the clicking part 172, and the push post 1221 is not contacted with the clicking block 1721. Under this circumstance, the push post 1221 is directly contacted with a surface of the clicking part 172.

The clicking element 17 is made of a soft elastic material, a hard elastic material or a composite elastic material.

Consequently, the clicking element 17 is capable of generating an elastic restoring force and is not readily damaged. The soft elastic material is silicone or polyvinyl chloride (PVC) glue. The hard elastic material is acrylonitrile butadiene styrene (ABS) resin, polycarbonate (PC), acrylic resin, stainless steel, galvanized steel (e.g., SECC or SGCC), aluminum or copper. The composite elastic material is a composite material of the soft elastic material and the hard elastic material. For example, the fixing part 171 and the clicking part 172 of the clicking element 17 are made of the soft elastic material, and the clicking block 1721 is made of the hard elastic material. Alternatively, the fixing part 171 and the clicking part 172 of the clicking element 17 are made of the hard elastic material, and the clicking block 1721 is made of the soft elastic material. In the above embodiment, the clicking block 1721 is assembled with the clicking part 172 of the clicking element 17. It is noted that numerous modifications and alterations may be made while retaining the teachings of the invention. For example, in another embodiment, the clicking element 17 is an integral structure.

Figure 3A:
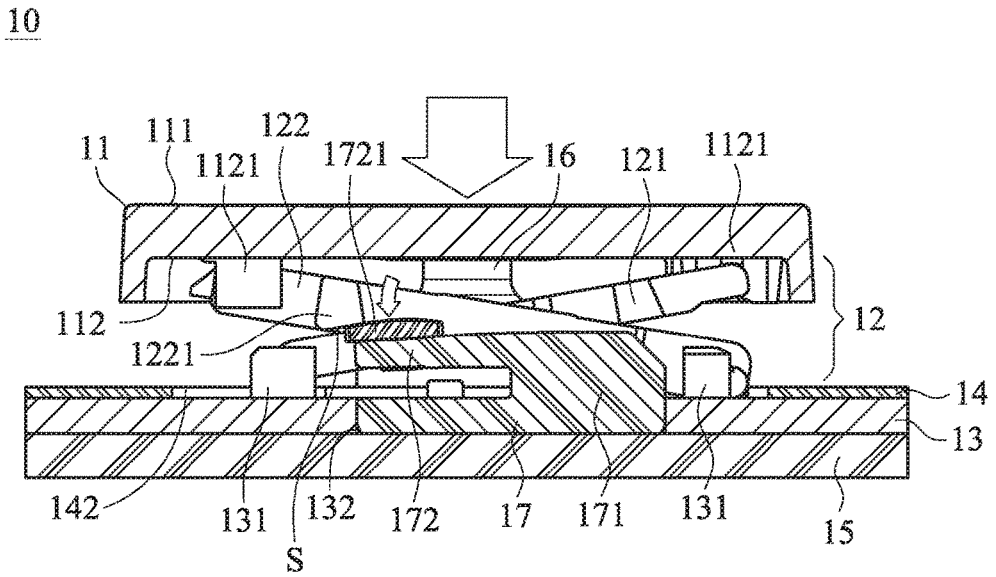
FIGS. 3A and 3B schematically illustrate the actions of the keyboard structure according to the embodiment of the present invention.
Figure 3B:
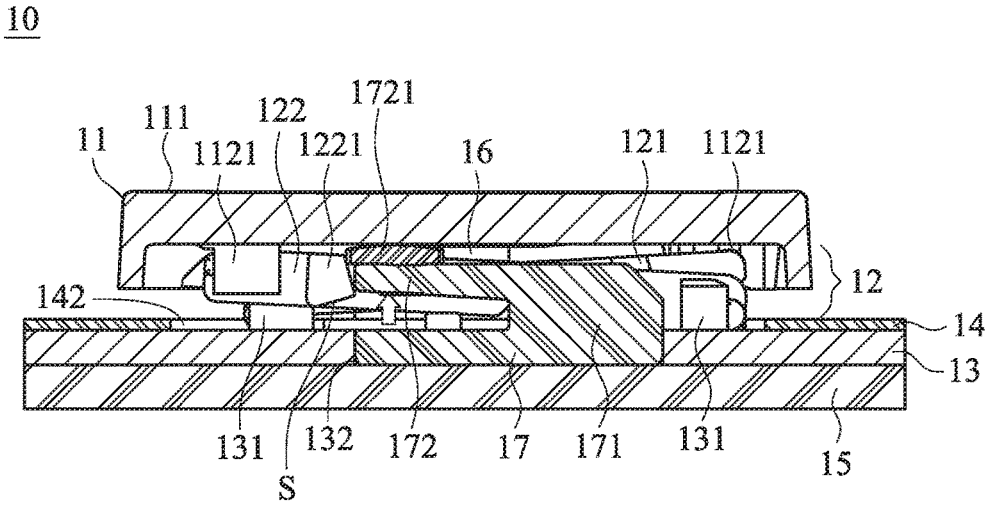

FIGS. 3A and 3B schematically illustrate the actions of the keyboard structure according to the embodiment of the present invention.

Please refer to FIG. 3A. While the pressing force is exerted on the top surface 111 of the keycap 11 and the keycap 11 is descended in response to the pressing force, the slant surface S of the push post 1221 on the lateral surface of the second frame 122 presses the clicking block 1721. Consequently, the clicking part 172 is subjected to curvy deformation. As the keycap 11 is continuously descended to the position to trigger the switch 141 to generate the keyboard signal, the clicking part 172 is moved along the slant surface S of the push post 1221 and separated from the push post 1221. Consequently, the push post 1221 and the clicking part 172 are not interfered with each other. Meanwhile, the clicking part 172 is elastically returned to its original position. While the clicking part 172 is elastically returned to its original position, the clicking block 1721 knocks on the bottom surface 112 of the keycap 11. In other words, when the user presses the keyboard structure to trigger the keyboard signal, the clicking part 172 knocks on the keycap 11 to generate the corresponding click sound. Consequently, the suitable typing rhythm of the user can be maintained. Moreover, in case that the material of the clicking block 1721 is adjusted, the clicking block 1721 knocks on the bottom surface 112 of the keycap 11 to generate a different click sound in order to meet the requirements of different users.

From the above descriptions, the present invention provides a keyboard structure. When compared with the conventional technologies, the process of assembling the keyboard structure of the present invention is simplified and the keyboard structure of the present invention is not readily damaged. When the keyboard structure is pressed, the proper click sound can be stably and continuously generated. In other words, the keyboard structure of the present invention is industrially valuable.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A keyboard structure, comprising: a keycap having a top surface and a bottom surface; a supporting plate; a clicking element located under the keycap; and a connecting element connected with the keycap and the supporting plate, wherein the connecting element comprises a push post, and the push post is contacted with the clicking element, wherein while the keycap is descended, the clicking element is pressed by the push post and subjected to curvy deformation and then the clicking element is separated from the push post, wherein when the clicking element is elastically restored to an original position to knock on the bottom surface of the keycap, a click sound is generated; wherein the connecting element comprises a first frame and a second frame, and the push post is disposed on a lateral surface of the second frame.

2. The keyboard structure according to claim 1, wherein the clicking element comprises a clicking part and a fixing part.

3. The keyboard structure according to claim 2, wherein the push post has a slant surface, and the slant surface is contacted with the clicking part, wherein while the keycap is descended, the clicking part is pressed by the slant surface of the push post and subjected to curvy deformation and then the clicking part is moved along the slant surface and separated from the push post, wherein when the clicking part is elastically restored to an original position to knock on the bottom surface of the keycap, the click sound is generated.

4. The keyboard structure according to claim 3, wherein the clicking part comprises a clicking block, wherein when the clicking block knocks on the bottom surface of the keycap, the click sound is generated.

5. The keyboard structure according to claim 2, wherein the supporting plate comprises a positioning hole corresponding to the fixing part, wherein the fixing part is accommodated within and positioned in the positioning hole, so that the clicking element is fixed in the supporting plate.

6. The keyboard structure according to claim 1, further comprising a membrane layer, wherein the membrane layer is located over the supporting plate, and the membrane layer comprises a switch corresponding to the keycap.

7. The keyboard structure according to claim 6, further comprising an elastic element, wherein the elastic element is located over the switch, and the elastic element provides an elastic restoring force to the keycap.

8. The keyboard structure according to claim 7, wherein while the keycap is descended, the elastic element is subjected to deformation and contacted with the switch, so that a keyboard signal is generated.

9. The keyboard structure according to claim 7, wherein the elastic element is made of rubber, silicone or metallic material.

10. The keyboard structure according to claim 1, further comprising a printed circuit board, wherein the printed circuit board is located under the supporting plate.

11. The keyboard structure according to claim 1, wherein the clicking element is made of a soft elastic material, a hard elastic material or a composite elastic material.

12. The keyboard structure according to claim 11, wherein the soft elastic material is silicone or PVC glue.

13. The keyboard structure according to claim 11, wherein the hard elastic material is ABS resin, polycarbonate, acrylic resin, stainless steel, galvanized steel, aluminum or copper.

14. The keyboard structure according to claim 11, wherein the composite elastic material is a composite material of the soft elastic material and the hard elastic material.

* * * * *